United States Patent [19]

Johnston

[11] 4,160,492

[45] Jul. 10, 1979

[54] CONTROL SYSTEM FOR MOBILE SELF-PROPELLED AERIAL LIFT

[75] Inventor: Roger L. Johnston, Muskego, Wis.

[73] Assignee: Simon-Krause, Inc., Milwaukee, Wis.

[21] Appl. No.: 840,012

[22] Filed: Oct. 6, 1977

[51] Int. Cl.[2] ..... B66F 11/04

[52] U.S. Cl. ..... 182/2; 182/148

[58] Field of Search ..... 182/2, 148, 141, 63; 60/488, 447

[56] References Cited

U.S. PATENT DOCUMENTS 3,890,783 6/1975 Allen ..... 60/488

*Primary Examiner*—Reinaldo P. Machado

*Attorney, Agent, or Firm*—James E. Nilles

[57] ABSTRACT

A mobile self-propelled aerial lift machine comprises a chassis, a swingable boom support structure mounted on the chassis, an elevatable telescopic boom mounted on the support structure and an adjustable work platform supported at the outer end of the boom. A plurality of hydraulic motors operable at variable speeds are provided to effect movement of the chassis, support structure, boom and work platform. The control system for the hydraulic motors includes an engine-driven destrokable radial piston-type pump mounted on the support structure and having a pressure port and a control (destroke) port whereby a change in the rate of fluid flow to the control (destroke) port effects a change in the fluid pressure at the pressure port. A plurality of solenoid operated selector valves are located on the support structure and are operable to permit fluid flow from the pressure port to the hydraulic motors. A control panel is located on the work platform and includes joystick-operated selector switches for operating the solenoids of the selector valves. A destroke conduit is provided for supplying fluid from the pressure port to the control (destroke) port and extends along the boom to the work platform. A pedal operated modulatable flow control valve is located on the work platform and connected to the destroke conduit for controlling fluid flow to the control (destroke) port to thereby control the speed of a hydraulic motor when the selector valve therefor is operated.

8 Claims, 6 Drawing Figures

CONTROL SYSTEM FOR MOBILE SELF-PROPELLED AERIAL LIFT

BACKGROUND OF THE INVENTION

1. Field of Use

This invention relates generally to control systems for variable speed hydraulic motors such as are used in mobile self-propelled aerial lifts which have an adjustably movable work platform on which the operator's controls for the functions of the aerial lift are located.

2. Description of the Prior Art

Mobile self-propelled aerial lifts typically include a work platform which is supported at the outer end of an elevatable telescopic boom which is carried on a swingable boom support structure on the vehicle chassis. Variable speed hydraulic motors are used to propel and steer the vehicle, rotate the boom support structure, raise and lower the boom, and extend and retract the boom. Some prior art electrohydraulic control systems for operating the aerial lift comprise an engine-driven constant flow pump located on the boom support structure for supplying pressurized hydraulic fluid through proportional solenoid operated proportional flow control valves to operate the hydraulic motors. In such prior art control systems, each proportional solenoid for a control valve is operated by a proportional type of electric control which operates the proportional valve so as to meter fluid flow therethrough to the hydraulic motor being controlled to thereby regulate the speed of movement of the motor and thus, the speed at which the particular function is carried out. Typically, the operator's control panel is located on the adjustably movable work platform and includes several proportional electrical controls as there are functions to be controlled. Proportional solenoid operated valves and the proportional electrical controls therefor are relatively complex and expensive and undue redundancy adds to the cost of manufacturing and servicing. The following U.S. patents depict prior art aerial lifts: U.S. Pat. Nos. 3,212,604 and 3,937,340.

SUMMARY OF THE PRESENT INVENTION

Broadly considered, a control system in accordance with the present invention for a hydraulic motor operable at variable speeds comprises a pump having a pressure port and a control port and being of a type wherein a change in the rate of fluid flow to the control port effects a change in the fluid pressure at the pressure port. A selector valve is provided and is operable to permit fluid flow from the pressure port to the hydraulic motor. Means are provided for operating the selector valve. A modulatable flow control valve is provided for controlling the rate of fluid flow to the control port to thereby control the speed of the hydraulic motor when the selector valve is operated. Means are provided for modulating the flow control valve.

In a preferred embodiment, a conduit is provided for supplying fluid from the pressure port to the control port and the modulatable flow control valve is connected to the conduit. The selector valve is a solenoid valve, the means for operating the selector valve is a manually operable selector switch, and the means for modulating the flow control valve is a foot pedal. A pump in accordance with the invention may take the form of a radial piston destrokable pump and the control port is a destroke port.

A mobile self-propelled aerial lift machine in accordance with the invention comprises a chassis, drivable and steerable ground-engaging wheels mounted on the chassis, a rotatable support structure mounted on the chassis, an elevatable telescopic boom mounted on the boom support structure, and a work platform mounted on the boom. A plurality of hydraulic motors are provided, including a drive motor for driving the wheels, a steering motor for steering the wheels, a swing motor for rotating the support structure, a boom hoist motor for raising and lowering the boom, and a telescope cylinder for extending and retracting the boom, each of the hydraulic motors being operable at variable speeds. The pump is mounted on the support structure and has a pressure port and a control port and is of the type wherein a change in rate of fluid flow to the control port effects a change in fluid pressure at the pressure port. An engine is provided on the support structure for driving the pump. A plurality of solenoid operated selector valves are mounted on the support structure, each selector valve being operable to permit fluid flow from the pressure port of the pump to one of the hydraulic motors. A plurality of manually operable selector switches are mounted on a control panel on the work platform, each selector switch controlling a solenoid for a selector valve. An electrical power source is provided on the support structure for energizing the solenoids. Conductor wires extend along the boom for connecting the selector switches to effect energization of the solenoids. Fluid conduit means extend along the boom between said support structure and the work platform for supplying fluid from the pressure port to the control port of the pump. A modulatable flow control valve is located on the work platform and is connected to the fluid conduit means for controlling the rate of fluid flow to the control port of the pump to thereby control the speed of any hydraulic motor selected for operation and the component moved thereby when the selector valve therefor is actuated by a selector switch. A foot-pedal control is located on the work platform for modulating the modulatable flow control valve.

An aerial lift machine in accordance with the invention also includes a pair of levelling cylinders, one connected between the support structure and the boom and the other connected between the boom and the work platform. Fluid conduit means are located along the boom and connected between the two levelling cylinders whereby movement of the one levelling cylinder effects related levelling movement of the other levelling cylinder. A manually operable levelling control valve is located on the work platform for effecting levelling adjustment of the other cylinder. The levelling control valve is connected to the same fluid conduit means to which the modulatable flow control valve is connected.

A control system in accordance with the present invention has many advantages over prior art arrangements. For example, costly and redundant proportional solenoid valves and proportional electrical controls therefor are eliminated, thereby substantially reducing the cost of manufacturing and maintaining the machine. Use of a radial piston pump which can be destroked by means of a destroke port thereon to control the pressure of fluid flow from the pressure port of the pump enables economic and effective regulation of fluid flow to any of the fluid motors in the system and eliminates the need for proportional flow control valves since standard more economic multi-position control valves operated by simple on-off solenoids and controlled by on-off switches can be used instead. Furthermore, in accordance with the invention, the pump is destroked by means of a pedal-operated proportional flow control valve thereby freeing the operator's hands and enabling him to devote his attention to selection of the appropriate selector switches for required control function selection. The pedal-operated valve effects variable fluid flow to the pump crank-case thereby making possible fully variable speeds in all functions being controlled, and this is accomplished by relatively simple direct-acting electrical switches and control valves. Other objects and advantages of the invention will hereinafter appear.

DESCRIPTION OF A PREFERRED EMBODIMENT

Figure 1:
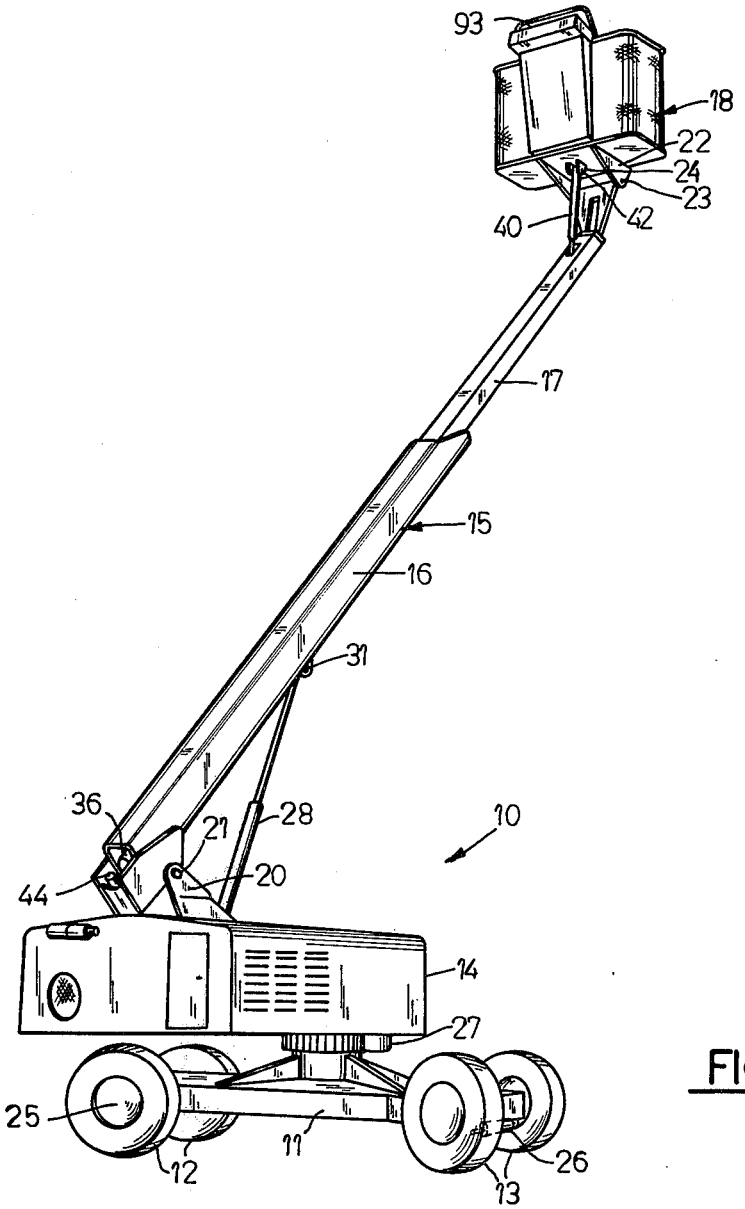
FIG. 1 is a perspective view of a mobile self-propelled aerial lift having an electrohydraulic control system in accordance with the invention and showing the telescopic boom raised and extended and the work platform in elevated position.
Figure 2:
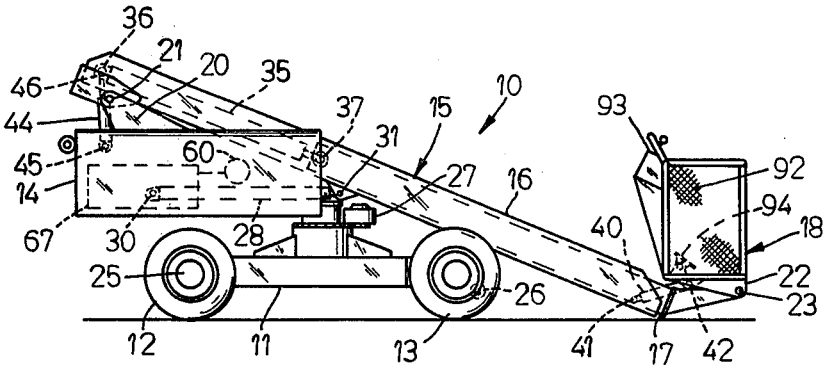
FIG. 2 is a side elevational view of the aerial lift shown in FIG. 1 and shows the telescopic boom fully retracted and fully lowered and the work platform in lowered position.

Referring to FIGS. 1 and 2, the numeral 10 designates a mobile self-propelled aerial lift machine of a type in which an electrohydraulic control system in accordance with the present invention is advantageously employed. Machine 10 comprises a vehicle chassis 11 having a pair of ground-engaging driven rear wheels 12, a pair of ground-engaging steerable front wheels 13, and a horizontally rotatable boom support structure 14 mounted thereon. Support structure 14 supports a vertically pivotable telescopic boom 15, comprising a base section 16 and movable section 17, which has a work platform 18 mounted on the outer end thereof.

Base section 16 of boom 15 is connected to a bracket assembly 20 on support structure 14 for pivotal movement in a vertical plane by a pivot pin 21. Platform 18 is connected by means of a bracket assembly 22 thereon and a pivot pin 23 to movable boom section 17 for adjustable pivotal movement in a vertical plane.

Figure 5:
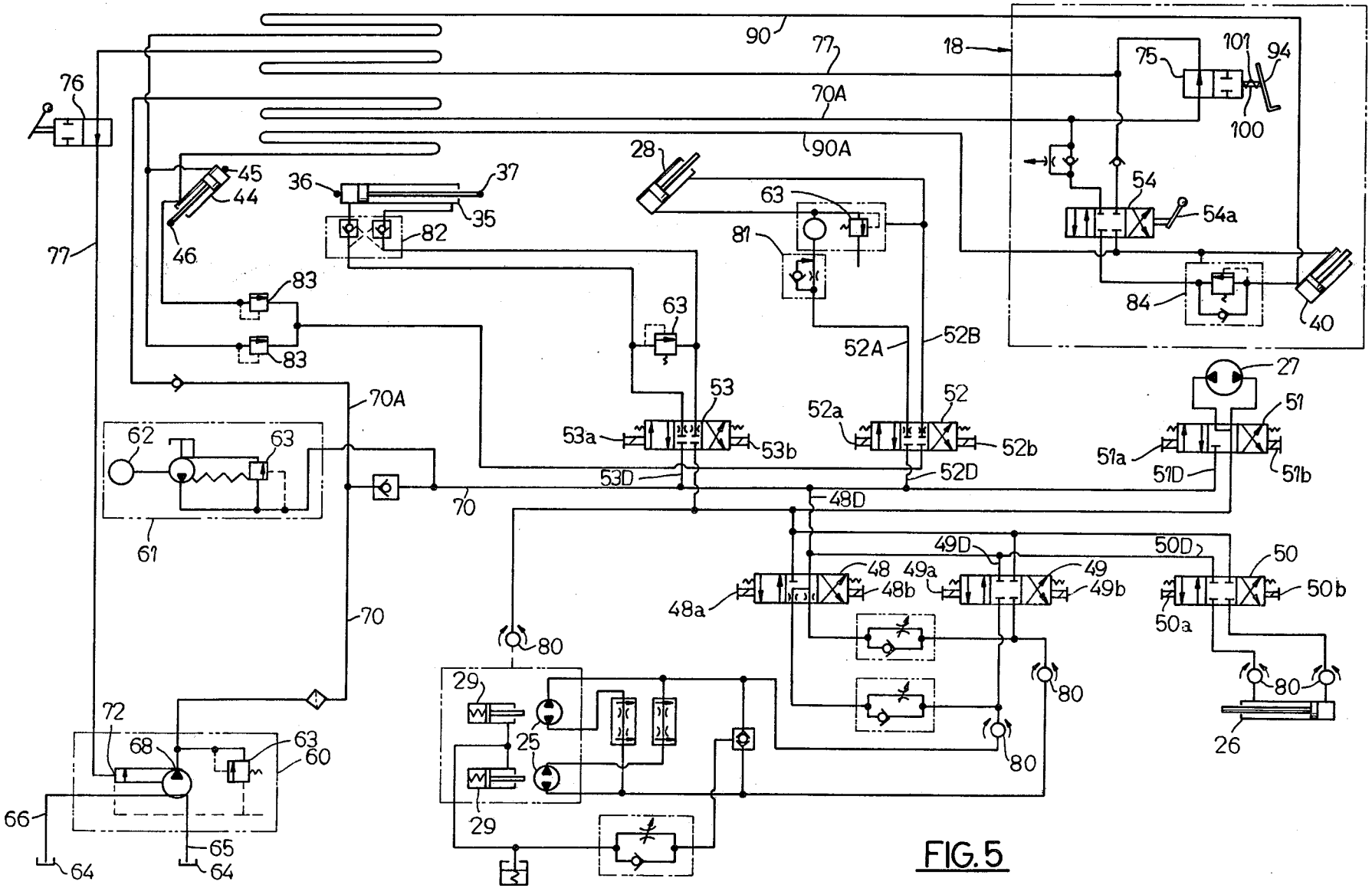
FIG. 5 is a schematic diagram of the hydraulic portion of the electrohydraulic control system in accordance with the invention.

As FIGS. 1, 2, and 5 make clear, the rear wheels 12 are driven by a pair of hydraulic reversable drive motors 25. Front wheels 13 are steerable by a hydraulic double-acting steering cylinder 26. Support structure 14 is rotatable in either direction by a hydraulic reversable swing motor 27. Boom 15 is raised and lowered by a hydraulic double-acting boom hoist cylinder 28 connected between support structure 14 and boom base section 16 by pivot pins 30 and 31, respectively. Movable boom section 17 is extendable and retractable relative to boom base section 16 by a hydraulic double-acting boom telescope cylinder 35 located within boom 15 and connected between the base end of boom base section 16 by a pin 36 and the base end of movable boom section 17 by a pin 37. Platform 18 is levelled by a hydraulic double-acting platform levelling cylinder 40 connected between movable boom section 17 by a pin 41 and a bracket 24 on the bottom of platform 18 by a pin 42. Cylinder 40 is operated by a hydraulic double-acting master levelling cylinder 44 connected between support structure 14 by a pin 45 and boom base section 16 by a pin 46.

The drive motors 25 are controlled by two double solenoid operated three-position four-way selector valves 48 (for low speed operation) and 49 (for high speed operation). Spring-applied fluid-released brake cylinders 29 are provided for the drive wheels 12.

Steering motor 26, swing motor 27, boom hoist cylinder 28, and boom telescope cylinder 35, are controlled by the double solenoid operated three-position four-way selector valves 50, 51, 52, and 53, respectively, which are spring biased to neutral position and actuatable therefrom in one direction (extend, right, forward) or another (retract, left, reverse) upon energization of the appropriate one of the two solenoids associated therewith.

Figure 6:
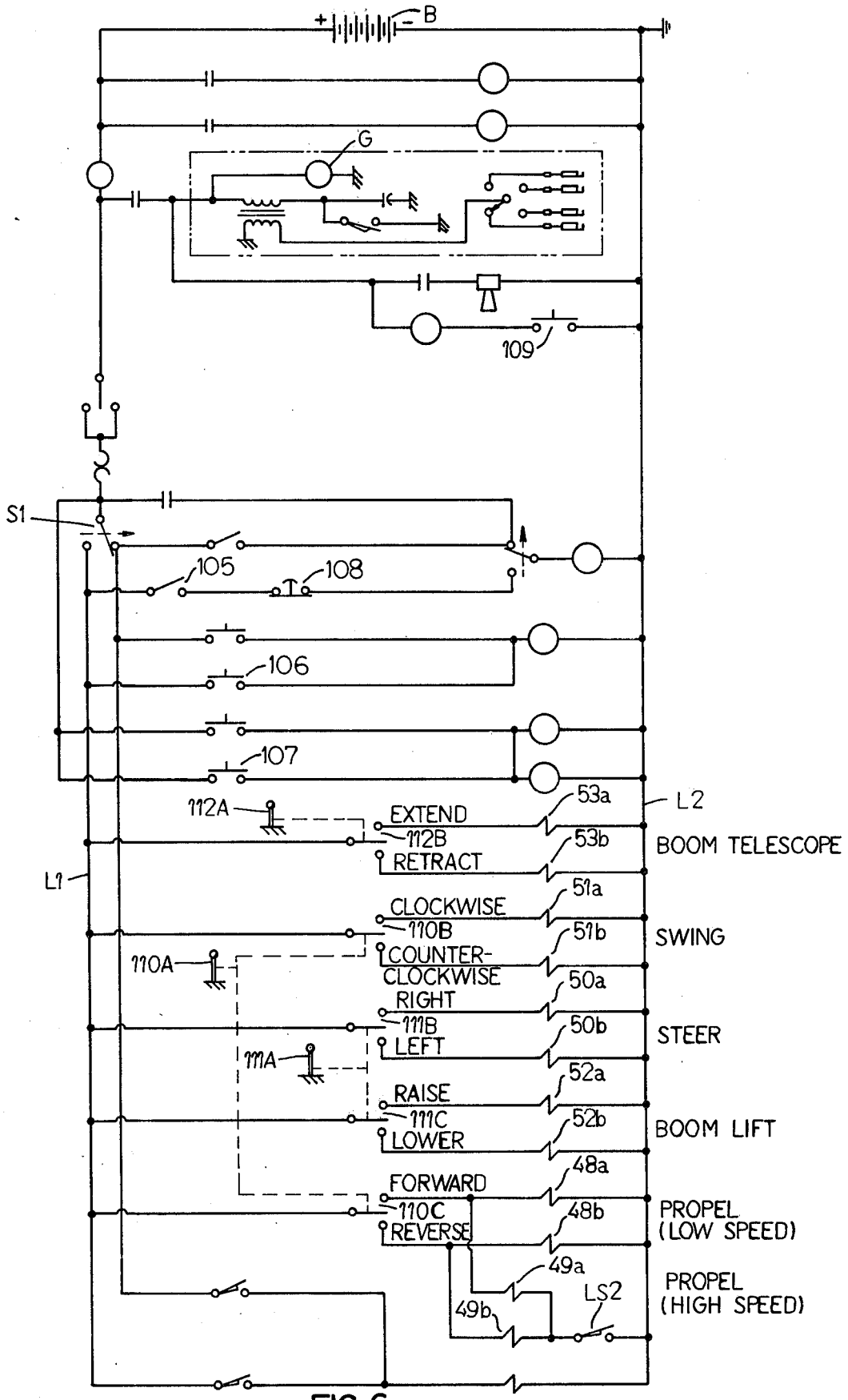
FIG. 6 is a schematic diagram of the electrical portion of the electrohydraulic control system in accordance with the invention and depicts the electrical connection of the solenoids of the solenoid controlled valves shown in FIG. 5.

As FIGS. 5 and 6 show, the on-off solenoids for the control valves 50, 51, 52, and 53 are designated by the same reference numeral as the valve with which they are associated followed by the suffix letter a or b.

Platform levelling cylinder 40 is adjustably controlled by a manually operable three-position four-way platform adjust control valve 54.

The cylinders and motors hereinbefore described are supplied with pressurized hydraulic fluid through their respective control valves from an engine-driven main pump 60, hereinafter described in detail, or in the event of emergency, from an emergency pump 61 driven by an electric motor 62, shown in FIG. 5. The pumps 60 and 61, the boom hoist cylinder 28 and the boom telescope cylinder 35 are provided with conventional pressure relief valves 63.

Engine driven radial piston destrokable main pump 60, shown in FIGS. 2 and 5, is driven by engine 67 and receives fluid from a reservoir 64 through fluid lines 65 and 66 and supplies pressurized fluid from its pressure port 68 through a main supply line 70 to the selector valves 48, 49, 50, 51, 52, 53, and through a branch supply line 70A to control valve 54. These valves supply pressurized fluid to the hydraulic motor controlled by a particular valve when the valve is moved from neutral to either of its operative positions. Pump 60 is a known commercially available pump which is capable of supplying fluid on demand, whenever a control valve is opened, at a pressure ranging, for example, from near 0 psi (30 to 40 psi) to 1800 psi, depending on the pilot fluid pressure maintained at a destroke port 72 on the pump. Thus, if the pressure at destroke port 72 is the same as that at pump pressure port 68, fluid pressure at the pressure port will be near zero. However, as the fluid pressure to destroke port 72 is reduced or choked off (as by means of closure of either of the normally open proportional destroke control valves 75 (pedal operated) and 76 (manually operated) in a destroke line 77 shown in FIG. 5), fluid pressure at pump pressure port 68 increases proportionately. A radial piston pump suitable for use as pump 60 is described in detail as regards construction and mode of operation in a publication designated FPD (7-74) entitled "PR24, 30, 40 and 60 Series Hydraulic Pumps Technical Manual" published by the John Deere Company, Waterloo, Iowa.

As FIGS. 2 and 5 show, the steering cylinder 26, and the drive motors 25, and the brake cylinders 24 are located on chassis 11, whereas the control valves 48, 49, and 50 therefor are located on the swingable boom support structure 14. Accordingly, five swivel-type hydraulic connectors 80, shown in FIG. 5, are provided.

As FIG. 5 also shows, boom hoist cylinder 28 is provided with a holding valve 81 and boom telescope cylinder 35 is provided with a pilot-operated double ball check valve 82. Master levelling cylinder 44 is provided with holding valves 83 and platform levelling cylinder 40, which is slaved to cylinder 44, is provided with a pilot valve 84.

As FIGS. 2 and 5 make clear, main pump 60, solenoid operated selector valves 48, 49, 50, 51, 52, and 53, and manually operable destroke control valve 76 are physically located on boom support structure 14. However, as FIGS. 2, 3, 4, 5, and 6 make clear, the pedal operated destroke control valve 75 and the operating pedal assembly 89 therefor, the manually operable platform adjust control valve 54, and the selector switches (hereinafter described) for the solenoid operated valves are located on the work platform 18.

Branch supply line 70A, destroke line 77, and a fluid communication line 90 connecting the master levelling cylinder 44 and platform levelling cylinder 40 are located along telescopic boom 15, preferably within boom base section 16 and on the side of movable boom section 17, and arranged in such a manner as to allow for extension and retraction of the telescopic boom. Electric conductors for the selector switches on platform 18 are similarly arranged.

Figure 3:
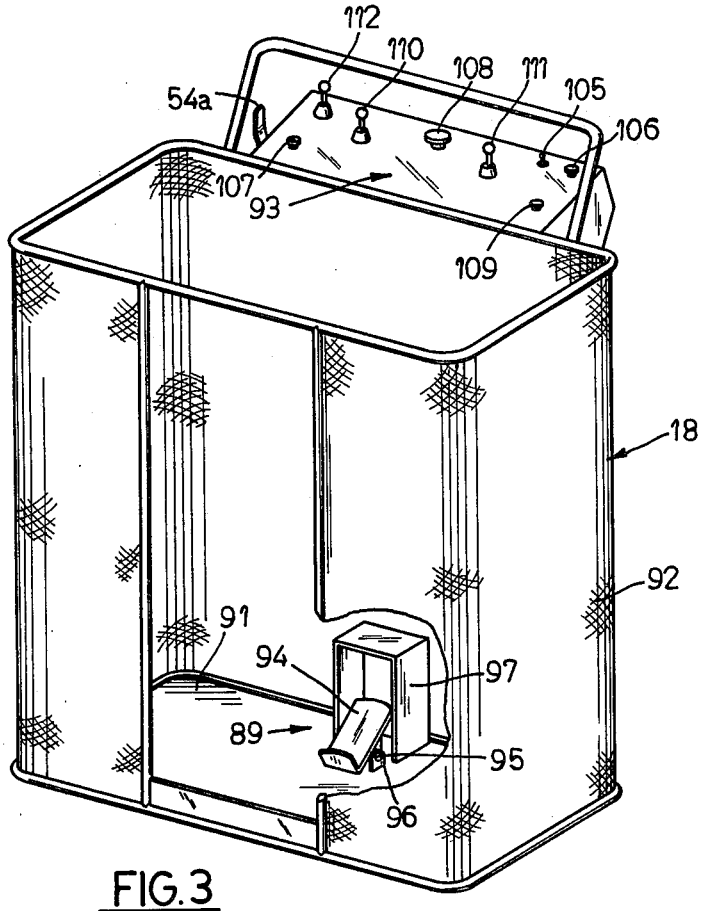
FIG. 3 is an enlarged perspective view of the work platform of FIGS. 1 and 2, with portions broken away to show details, and showing the operator's control panel and showing the independently operable foot pedal for effecting modulation or proportional control.

As FIGS. 3 and 4 best show, the movable work platform 18, which is adapted to carry a human operator to a desired elevated location and comprises a floor 91 and wire mesh sides 92, is provided with a control panel 93 hereinafter described. The operating pedal assembly 89 for operating destroke valve 75 comprises a foot pedal 94 which is pivotally connected by a pivot pin 95 to a support bracket 96 rigidly mounted on floor 91 and protected against accidental application by a protective housing 97. Pedal 94, which is operatively connected to valve 75 by a linkage 100, is biased by a biasing spring 101 to a non-depressed position wherein it maintains valve 75 in fully open position. Pedal 94 is depressable by the operator against the bias of spring 101 to effect movement of proportional valve 75 from fully open position, through partially closed position to fully closed position to thereby effect a desired reduction of fluid flow in destroke line 77. Reduction of fluid flow to destroke port 72 of pump 60 effects a corresponding increase of fluid pressure at pressure port 68 of the pump.

The control panel 93 supports a manual control lever 54*a* for levelling valve 54, the selector switch assemblies hereinafter described, which control the solenoids of the selector valves, and other switches, such as an on-off ignition switch 105, an engine start switch 106, an emergency power switch 107, an emergency stop switch 108, and a horn switch 109. The selector switch assemblies include a combined propulsion control and swing control switch assembly 110, a combined steering and boom lift control switch assembly 111, and a combined boom extension control switch assembly 112. The switch assemblies 110, 111, and 112, which are known commercially available devices, each include a joystick 110A, 111A, and 112A, respectively, which is movable from a spring centered neutral position in four cardinal directions to effect operation of one or more single pole double throw switches associated therewith. A suitable switch assembly for use in the present invention is identified as a Class 9001, Type K, Series F switch manufactured by the Square D Company, Milwaukee, Wisconsin.

Figure 4:
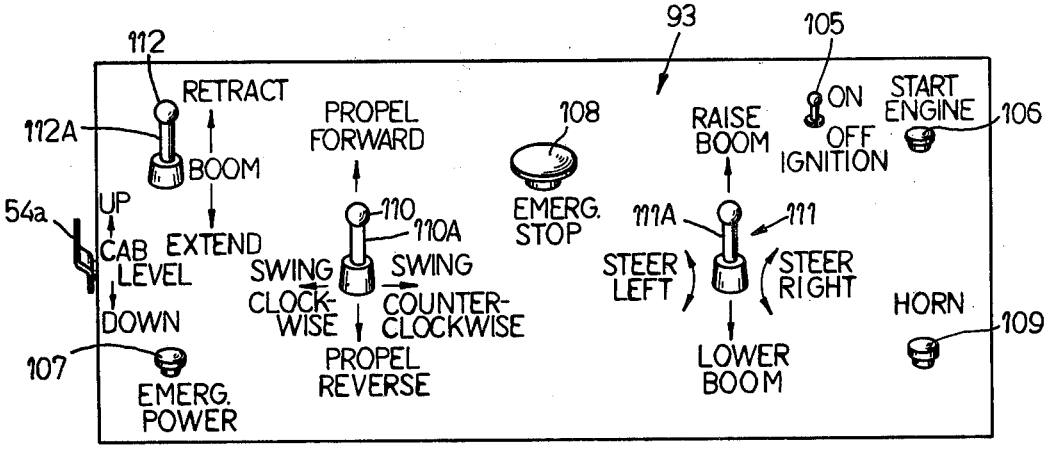
FIG. 4 is an enlarged perspective view of the operator's control panel shown in FIG. 3.

As FIGS. 4, 5, and 6 show, in switch assembly 110, joystick 110A operates (when moved left and right in FIG. 4) a single pole double throw switch 110B for controlling the solenoids 51*a* and 51*b* of selector valve 51 for swing control motor 27 and also operates (when moved forward or rearward in FIG. 4) a single pole double throw switch 110C for controlling the solenoids 48*a* and 48*b* of selector valve 48 for the propulsion motors 25. A normally open limit switch LS2 controls energization of the solenoids 49*a* and 49*b* of selector valve 49 for high speed operation of the motors 25 and responds to full throw of joystick 110A in forward or reverse direction.

In switch assembly 111, joystick 111A operates (when moved left or right in FIG. 4) a single pole double throw switch 111B for controlling the solenoids 50*a* and 50*b* of selector valve 50 for steering motor 50 and also operates (when moved forward or rearward in FIG. 4) a single pole double throw switch 111C for controlling the solenoids 52*a* and 52*b* of selector valve 52 for boom hoist cylinder 28.

In switch assembly 112, joystick 112A operates (when moved forward or rearward in FIG. 4) a single pole double throw switch 112B for controlling the solenoids 53*a* and 53*b* of selector valve 53 for boom telescope cylinder 35.

As FIG. 6 shows, the normally open switches are in series circuit with the respective solenoids they control across supply lines L1 and L2 which are energizable from a generator G driven by engine 67, or alternatively by means of a selector switch S1, from a battery B on the vehicle.

OPERATION

The aerial lift machine 10 in accordance with the invention operates as follows. Assume that the machine is in the condition shown in FIG. 2 and that it is desired, for example, to operate it so that it assumes the position shown in FIG. 1 wherein support structure 14 is swung to the left, boom 15 is raised and extended, and platform 18 is level. Further assume that the machine operator is occupying the work platform 18 and has access to the controls therein. Also assume that engine 67 is in operation, that main pump 60 is running, that the selector switches 110, 111, and 112 shown in FIG. 4 are in neutral whereby the selector valves controlled thereby are in neutral and that foot pedal 94 is not depressed.

In this condition, fluid from pressure port 68 of pump 60 flows through lines 70, 70A, normally open destroke valve 75, destroke line 77, normally open manual destroke valve 76 to destroke port 72 of main pump 60. With the destroke valves 75 and 76 both fully open, fluid flow from pump pressure port 68 to destroke port 72 is at a maximum and, therefore, fluid pressure at port 68 is at a minimum value, i.e., about 30 to 40 psi and just sufficient to effect destroking of pump 60.

The operations necessary to change machine 10 from the condition shown in FIG. 2 to that shown in FIG. 1 can be carried out in any desired sequence. Furthermore, since operation of the selector switches and the selector valves controlled thereby are the same, only the operation of switch assembly 111 to effect boom lift will hereinafter be described in detail. Joystick 111A of switch assembly 111 is moved forwardly (with respect to FIG. 4) to the boom raise position thereby effecting closure of switch 111C to cause energization of solenoid 52*a* of selector valve 52 for boom hoist cylinder 28. As this occurs, pressurized fluid is able to flow from pressure port 68 of main pump 60, through main supply line 70, through branch line 52D, and through the branch line 52A connected between valve 52 and boom hoist cylinder 28 which supplies fluid to the extend chamber of cylinder 28. Fluid exhausted from the other chamber of boom hoist cylinder 28 flows through line 52B through valve 52 to the reservoir 64. While valve 52 is thus in the extended position and open, fluid pressure from pressure port 68 of pump 60 remains at the minimum value and boom hoist cylinder 28 extends at its slowest rate. However, if the machine operator depresses foot pedal 94 to effect proportional closure of modulatable destroke valve 75, fluid flow through destroke line 77 to destroke port 72 of main pump 60 is diminished. As this occurs, main pump 60 becomes destroked and the pressure at pressure port 68 increases in proportion to the degree of closure of destroke valve 75, thereby supplying fluid at increased pressure to boom hoist cylinder 28 and causing the cylinder to extend more rapidly. Modulation of pedal operated destroking valve 75 by the machine operator thus enables him to regulate the speed at which boom hoist cylinder 28 is extended. When boom hoist cylinder 28 is extended to the desired degree, closure of selector valve 52 is effected by returning joystick 111A of switch assembly 111 to neutral thereby deenergizing solenoid 52*a* and effecting return of valve 52 to neutral.

As hereinbefore explained, each of the hydraulic motors is operable in substantially the same manner for extend or retract (forward-reverse, right-left) operations.

As hereinbefore explained, the manually operable destroke valve 76 is located on support structure 14 and is accessible to a person standing on the ground to enable him to effect modulation of a control function being carried out by operation of the appropriate selector switch.

The emergency pump 61 is a conventional pump which merely provides sufficient fluid pressure in the event of failure of main pump 60 to enable valve operations necessary to return the machine to a safe condition.

As regards operation of platform levelling cylinder 40, it is to be understood that raising or lowering of telescopic boom 15 by means of boom hoist cylinder 28 causes the boom to move the piston of master levelling cylinder 44. Thus, fluid is exchanged between master levelling cylinder 44 and platform levelling cylinder 40 through the conduits 90 and 90A, thereby causing movement of platform levelling cylinder 40 which effects levelling of work platform 18. In the event that desired levelling does not result as a consequence of operation of master levelling cylinder 44, the machine operator can by manipulation of lever 54*a* operated levelling valve 54 so as to supply fluid from branch line 70A to the appropriate chamber of platform levelling cylinder 40, thereby effecting necessary levelling adjustment.

I claim:

1. In an aerial lift machine:
a movable work platform;
a hydraulic motor operable at variable speeds to move said work platform;
a pump having a pressure port and a control port and being of a type wherein a change in the rate of fluid flow to said control port effects a change in the fluid pressure at said pressure port;
means for driving said pump;
a conduit for supplying fluid from said pressure port to said control port;
a selector valve operable to permit fluid flow from said pressure port to said hydraulic motor;
means located on said work platform for operating said selector valve;
a modulatable flow control valve connected to said conduit for controlling the rate of fluid flow to said control port to thereby control the speed of said hydraulic motor when said selector valve is operated;
and means located on said work platform for modulating said flow control valve.

2. A machine according to claim 1, wherein modulatable flow control valve is located on said work platform and said conduit extends to said work platform.

3. A machine according to claim 2, wherein said selector valve is a solenoid valve and wherein said means for operating said selector valve is a manually operable selector switch.

4. A machine according to claim 3, wherein said means for modulating said flow control valve is a foot pedal.

5. A machine according to claim 4, wherein said pump is a radial piston destrokable pump and said control port is a destroke port.

6. A machine according to claim 4, including a plurality of hydraulic motors to effect plural movement of said work platform, a plurality of solenoid operated selector valves, one for each of said plurality of hydraulic motors, and a plurality of selector switches located on said work platform for operating said plurality of selector valves.

7. In a mobile self-propelled aerial lift machine:
a chassis;
drivable and steerable ground-engaging wheels mounted on said chassis;
a rotatable support structure mounted on said chassis;
an elevatable telescopic boom mounted on said boom support structure;
a work platform mounted on said boom;
a plurality of hydraulic motors, including a drive motor for driving said wheels, a steering motor for steering said wheels, a swing motor for rotating said support structure, a boom hoist motor for raising and lowering said boom, and a telescope cylinder for extending and retracting said boom, each of said hydraulic motors being operable at variable speeds;
a pump mounted on said support structure and having a pressure port and a control port and being of a type wherein a change in rate of fluid flow to said control port effects a change in fluid pressure at said pressure port;

an engine on said support structure for driving said pump;

a plurality of solenoid operated selector valves mounted on said support structure, each selector valve being operable to permit fluid flow from said pressure port of said pump to one of said hydraulic motors;

a plurality of manually operable selector switches mounted on said work platform, each selector switch controlling a solenoid for a selector valve;

an electrical power source on said support structure for energizing said solenoids;

conductor wires along said boom for connecting said selector switches to effect energization of said solenoids;

fluid conduit means extending along said boom between said support structure and said work platform for supplying fluid from said pressure port to said control port of said pump;

a modulatable flow control valve on said work platform and connected to said fluid conduit means for controlling the rate of fluid flow to said control port of said pump to thereby control the speed of a hydraulic motor and a component moved thereby when the selector valve therefor is actuated by a selector switch;

and a foot-pedal control located on said work platform for modulating said modulatable flow control valve.

8. A machine according to claim 7 including a pair of levelling cylinders, one connected between said support structure and said boom and the other connected between said boom and said work platform, fluid conduit means located along said boom and connected between said levelling cylinders whereby movement of said one levelling cylinder effects related levelling movement of the other levelling cylinder, and a manually operable levelling control valve located on said work platform for effecting levelling adjustment of said other cylinder, said levelling control valve being connected to said conduit to which said modulatable flow control valve is connected.

* * * * *